US006099147A

United States Patent [19]

Ziegenfuss

[11] Patent Number: 6,099,147

[45] Date of Patent: Aug. 8, 2000

[54] FLASHLIGHT LAMP SHOCK ABSORBER

[75] Inventor: Peter John Ziegenfuss, Borough of Sellersville, Pa.

[73] Assignee: Streamlight, Inc., Norristown, Pa.

[21] Appl. No.: 09/196,467

[22] Filed: Nov. 19, 1998

[51] Int. Cl.[7] ..... F21L 4/00; F21V 31/00

[52] U.S. Cl. ..... 362/319; 362/158; 362/187; 362/277

[58] Field of Search ..... 362/158, 319, 362/277, 187

[56] References Cited

U.S. PATENT DOCUMENTS

| | | | |
|---|---|---|---|
| 1,613,069 | 1/1927 | Voorhees . | |
| 2,860,233 | 11/1958 | Johnson . | |
| 4,683,523 | 7/1987 | Olsson | 362/158 X |
| 4,823,242 | 4/1989 | Magilica et al. | 362/187 |
| 4,864,474 | 9/1989 | Magilica | 362/187 X |
| 4,888,670 | 12/1989 | Sharrah | 362/187 X |
| 4,967,328 | 10/1990 | Tatavoosian | 362/267 |
| 5,126,927 | 6/1992 | Reves et al. | 362/187 |
| 5,309,337 | 5/1994 | Groben | 362/206 |
| 5,432,689 | 7/1995 | Sharrah et al. | 362/183 |
| 5,463,541 | 10/1995 | Greene | 362/369 |
| 5,678,921 | 10/1997 | Kish et al. | 362/205 |

OTHER PUBLICATIONS

Brochure, "Carley Lamps . . . Subminiature Lamps & Reflectors", 1990.

Catalog, "Miniature & Sealed Beam Lamp Catalog", GE Lighting, Oct. 1994.

Brochure "Philips Signalling Lamps", Philips Lighting Company, 1988.

*Primary Examiner*—Laura K. Tso

*Attorney, Agent, or Firm*—Dann, Dorfman, Herrell and Skillma, P.C.

[57] ABSTRACT

A flashlight comprises a housing including a cavity adapted for receiving a battery and a reflector mounted to said housing and having a light-reflecting surface and a bore therethrough for receiving a lamp. The bore includes a circumferential groove therein and an annular ring or O-ring of resilient material in the groove. The lamp has a filament and has a pair of electrical leads at one end thereof. An electrical connector is mounted to the housing and engages the electrical leads of the lamp for holding the lamp in the bore of the reflector within the annular O-ring of resilient material for cushioning the lamp against physical shocks. Battery terminals in the cavity of the housing connect the lamp in circuit with the battery which provides electrical power for energizing the lamp filament to produce light. The reflector may be moveably mounted with respect to the lamp, such as by a rotatable threaded mounting of the reflector, for changing the relative position of the light-reflecting surface of the reflector with respect to the lamp filament thereby to change the focus of the beam of light produced.

28 Claims, 3 Drawing Sheets

FLASHLIGHT LAMP SHOCK ABSORBER

The present invention relates to flashlights and, in particular, to shock absorbers for flashlight lamps.

Whenever there is need to look into dark or dim places, whether outdoors or indoors where lighting is inadequate or when the electrical service is disrupted, people turn to portable lights, such as flashlights. Flashlights are regularly and frequently called upon in a wide variety of difficult and emergent situations where reliability and dependability are of great importance.

The most prevalent cause of flashlight inoperability, apart from a discharged battery, is failure of the flashlight lamp, most often due to filament breakage. Modern flashlights employ either alkaline cells having long shelf life or rechargeable batteries, such as nickel-cadmium cells, that have largely overcome the problem of batteries discharging when not in use.

The most common cause of lamp failure is a shock that breaks the lamp filament which is a fine wire through which electrical current flows to heat it to a temperature sufficient to cause it to produce light. As the lamp filament ages from use, it becomes thinner and thus even more susceptible to breakage than when new.

Among the uses of flashlights that are most likely to impart substantial shocks to the flashlight, such as from being hit against objects or being dropped or falling onto a hard surface, are those uses by law enforcement personnel and by utility and industrial workers, all of which are likely to involve difficult and emergent situations where reliability and dependability are of the flashlight are of great importance to the safety of personnel and the preservation of property. These are also the personnel who are likely to use their flashlights often, thereby aging the filament and rendering it more susceptible to breakage.

In addition, it is often desirable to be able to adjust the focus of the light beam produced by the flashlight to better illuminate the area or object of interest to the user. In particular, it is often the law enforcement personnel and utility and industrial workers who require a dependable and reliable flashlight that also often need the ability to adjust the focus of the light beam to best illuminate the areas and objects which they are inspecting and/or working on.

Conventional shock absorbing lamp mounting systems, such as that described in U.S. Pat. No. 4,967,328 to Tatavoosian, seek to compress a lamp in a resilient mounting. Specifically, Tatavoosian requires a rubber ring disposed snugly over the glass body of a lamp and bearing against a shoulder of the body of the lamp, and a rubber strip disposed against the opposite end of the lamp body, both of which are held fixed and in compression by a reflector and a housing. Tatavoosian requires a lamp having a body that must be of greater diameter than the glass bulb of the lamp, and does not allow for relative movement of the lamp and reflector as for adjusting the focus of the light beam emitted from the lamp.

Other conventional flashlights, such as that described in U.S. Pat. No. 5,678,921 to Kish et al., have a bulb socket integrally molded into the flashlight casing, and has a reflector that is axially movable with respect to the bulb to afford adjustable focusing of the light emitted from the bulb. The bulb of Kish et al. has a conventional base with an outwardly extending flange that is mounted in the bulb socket where it is held by its flange and a spring that bears against the opposite end of the bulb base. The bulb is said to be "resiliently axially moveable with respect to the socket." While the arrangement of Kish et al. may allow a limited rearward motion of the bulb by its base compressing the spring, as would be the case if the flashlight were to be dropped on its rearward end, it is not evident how the Kish et al. arrangement would absorb shocks imparted radially or those imparted axially from the forward end of the flashlight. Moreover, Kish et al. support the bulb by its base and do not support the glass bulb portion containing the delicate filament.

Accordingly, there is a need for a light that has a shock-absorbing lamp mounting arrangement that cushions the lamp and thereby reduces its susceptibility to filament breakage from drops, bangs and other shocks. It is also desirable that the focus of the light beam of the light be readily adjustable by the user.

To this end, the present invention comprises a lamp having electrical leads at one end thereof and a reflector having a light-reflecting surface and a bore therethrough for receiving the lamp. The bore has a circumferential grove therein and an annular ring of resilient material in the groove of the bore. An electrical connector engages the electrical leads of the lamp for holding the lamp in the bore of the reflector within the annular ring of resilient material and is adapted for connecting the lamp to a source of electrical power.

BRIEF DESCRIPTION OF THE DRAWING

The detailed description of the preferred embodiments of the present invention will be more easily and better understood when read in conjunction with the FIGURES of the Drawing which include.

DESCRIPTION OF THE PREFERRED EMBODIMENT

Figure 1:
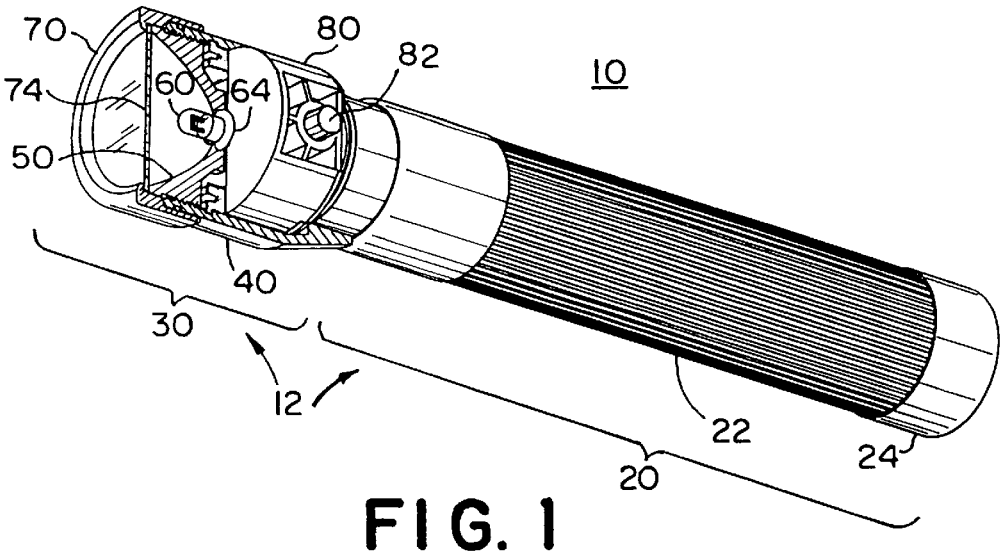
FIG. 1 is a diagram of a flashlight, partially sectioned, including an embodiment of the present invention.

In the flashlight 10 of FIG. 1, housing 12 includes a barrel portion 20 and a head assembly 30. Barrel 20 is typically a hollow cylindrical tube adapted for receiving therein one or more batteries or an assembly of battery cells (not visible in FIG. 1) that provide the electrical power employed to cause the light source of flashlight 10 to produce light. Barrel 20 may include an outer grip 22 as may be formed of a material that is easy to handle and is not slippery, such as a knurled area 22 on a metal or plastic barrel 20 or a rubber or plastic sleeve 22 on barrel 20. Tail cap 24 is typically removable from the remainder of barrel 20, such as by being unscrewed from the rearward end thereof, to facilitate the installation, removal and replacement of batteries inside the hollow tube of barrel 20. Barrel 20 may also include one or more electrical conductors (not shown) as is known for connecting the batteries in circuit with the light source and switch of head assembly 30 described herein below. Alternatively, the battery may be arranged to have both positive and negative terminals on the end thereof that is inserted into barrel 20 to be proximate to head assembly 30 for contacting corresponding contacts on switch module 80. U.S. Pat. No. 5,432,689 entitled "Flashlight and Recharging System Therefor" issued Jul. 11, 1995 to Raymond L. Sharrah et al. and assigned to Streamlight, Inc. of Norristown, Pa., describes an adjustable focus flashlight and the electrical circuit therein including batteries and a light source, and a system for recharging such batteries, which patent is in its entirety hereby incorporated herein by reference. Where barrel 20 is formed of a metal, such as aluminum, barrel 20 may serve as the electrical conductor from the rearward terminal of the battery and the forward terminal of the battery contacts a conductor of switch module 80.

Figure 2:
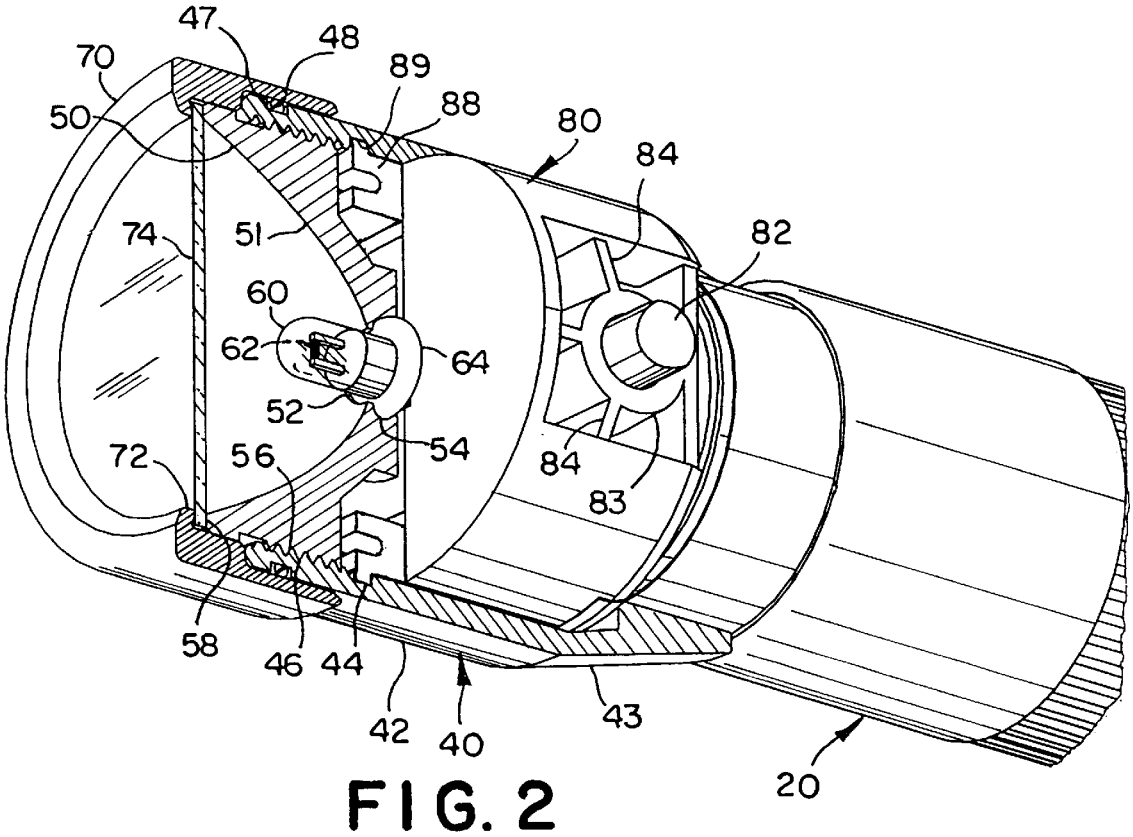
FIG. 2 is an enlarged diagram of a portion of the flashlight of FIG. 1.

Head assembly 30 of FIG. 1, which is also shown enlarged in FIG. 2 and will be described with respect thereto, includes a head housing 40 having a cylindrical portion 42 forward and a conical portion 43 rearward forming a transition for attaching head housing 40 to the forward end of barrel 20. Head housing 40 supports the various components of head assembly 30, such as reflector 50, lamp 60, lens ring 70, lens 74 and switch module 80. Reflector 50 has a parabolic light-reflecting surface 51 for directing light from filament 62 of lamp 60 in an axially forward direction and has external threads 56 on its cylindrical outer surface for engaging the internal threads 46 on the inner surface of cylindrical portion 42 of head housing 40. Reflector 50 has a cylindrical bore 52, preferably coaxial with the central axis of reflecting surface 51, in which lamp 60 is held by switch module 80. A circumferential grove 54 in bore 52 of reflector 50 holds an annular ring of resilient material as is provided by O-ring 64. As is explained below, O-ring 64 surrounds lamp 60 and is proximate thereto so as to provide a cushion against shocks to the head assembly 30 and barrel 20 being transmitted to filament 62 of lamp 60, but need not be in contact with lamp 60.

Lens ring 70 is a hollow cylindrical member into which reflector 50 is press fit to hold circular lens 74 between inwardly extending flange 72 of lens ring 70 and forward end 58 of reflector 50. The press-fit assembly of reflector 50, lens ring 70 and lens 74 is in threaded engagement with head housing 40 by the external threads 56 of reflector 50 engaging the internal threads 46 of head housing 40. Circumferential groove 47 in the external surface of head housing 40 holds a resilient annular member such as O-ring 48 that bears against the inner surface of lens ring 70 thereby to form a water-resistant seal, and also to provide a frictional resistance for holding lens ring 70 and housing 40 in a desired relative relationship.

Head housing 40 has an internal groove 44 for holding switch module 80 in position in head housing 40. To that end, internal groove 44 in the inner surface of cylindrical portion 42 of head housing 40 receives arcuate flange 89 extending outwardly from two opposing arcuate lugs 88 that extend axially from the forward face of switch module 80 and that flex radially so that switch module 80 will snap together into head assembly 30. Switch module may also be secured in head assembly 30 by one or more screws passing radially through the cylindrical portion 40 thereof and threading into switch module 80. Switch module 80 includes a push-button switch 82 that is actuated by movement in a radially inward direction for opening and closing an electrical circuit including lamp 60 and the battery (not shown) to cause lamp 60 to illuminate. Push-button switch 82 moves radially within a cylindrical sleeve 83 that is supported by a plurality of radial supports 84, the arrangement thereof beneficially maintaining a relatively consistent thickness of the walls of switch module 80 which is helpful in molding switch module 80 as a plastic part. A switch gasket (not shown) covers the push button of switch 82 to seal switch 82 against external moisture and thereby cooperates with the other seals such as O-ring 48 to maintain flashlight 10 water resistant.

Figure 3:
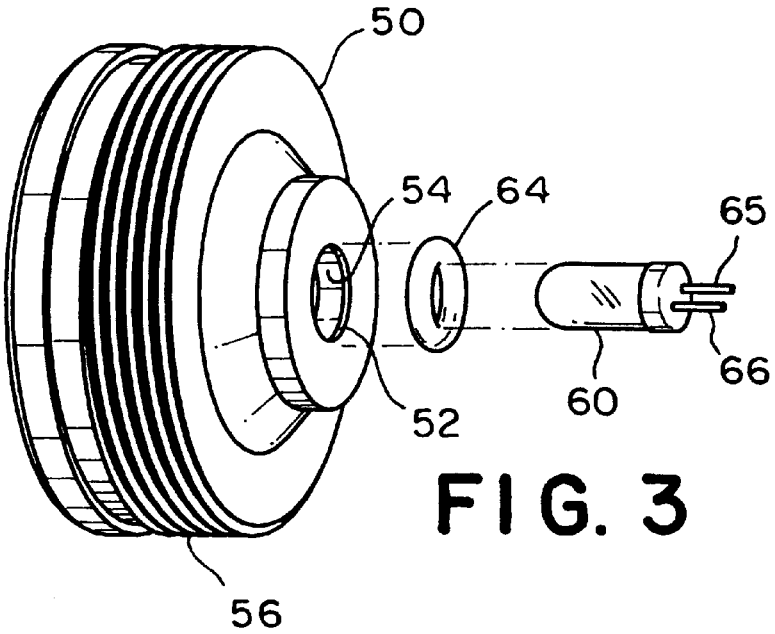
FIG. 3 is an exploded view of the reflector assembly of the portion of the flashlight of FIG. 2.

In FIG. 3, an "exploded" view of the reflector 50, it is seen that O-ring 64 is inserted into bore 52 of reflector 50 to rest in the circumferential groove 54 therein and that lamp 60 fits inside the hole of O-ring 64. Lamp 64 is preferably a lamp having a cylindrical or tubular envelope and a bi-pin, leaded or wedge-type base, i.e. a base that does not rigidly attach lamp 60 to head assembly 30, but which will allow some movement of the bulb portion of lamp 60 while maintaining contact with its electrical leads. Many lamps of this type are available commercially from many sources, for example, General Electric Company, GE Lighting located in Cleveland, Ohio, Philips Lighting Company located in Somerset, New Jersey, and Carley Lamps. Inc., located in Torrance, California. Mostly, high-intensity xenon lamps are preferred, such as a size T-1½ bi-pin xenon lamp. Metal pins 65 and 66 extending axially from the base of lamp 60 provide the means, i.e. electrical leads, through which electrical current is conducted to the filament 62 of lamp 60 as well as the means, i.e. mechanical support, by which lamp 60 is supported and held in position in bore 52. It is not necessary that lamp 60 have a metal or other base, it may simply be a glass capsule, because the present invention does not rely upon clamping against the end and/or shoulder of a lamp base to provide support for lamp 60.

Figure 4:
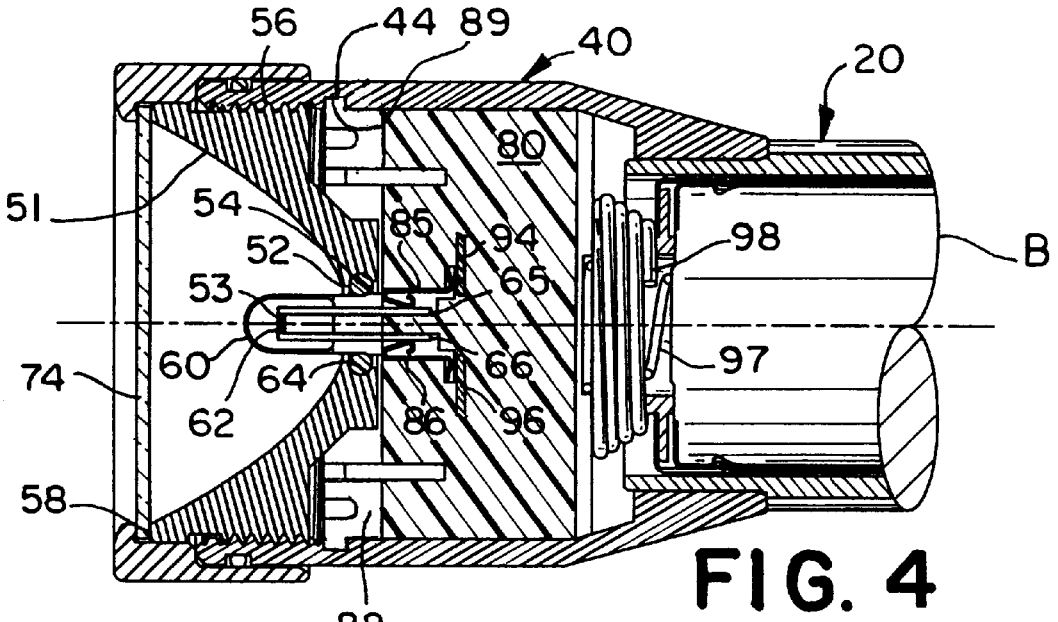
FIG. 4 is a cross-sectional diagram of the reflector assembly of the portion of the flashlight of FIG. 2.

Further detail of the arrangement of lamp 60 in the bore 52 of reflector 50 is provided in the cross-sectional diagram of FIG. 4. Resilient O-ring 64 rests in the circumferential groove 54 in the surface of cylindrical bore 52 through reflector 50, and lamp 60 is positioned through the center of O-ring 64. While the outer surface of lamp 60 may bear against the inner surface of O-ring 64, that is not necessary to the proper functioning of the present invention. In fact, if lamp 60 is in contact with O-ring 64, it is preferred that such contact be light and not eliminate the ability to move lamp 60 axially within bore 52, as is advantageous where it is desired to provide flashlight 10 with an adjustable beam of light.

One beneficial aspect of the foregoing arrangement is that lamp 60 is cushioned by O-ring 64 in a region along its length that will be, in general, closer to its filament 62 than would be the case if lamp 60 were to be cushioned where it is supported, i.e. at its base. Where a lamp is cushioned at a location far from its filament, there exists the condition where shocks to the lamp may be transmitted to its filament or may even be amplified as by a "whip-lash" effect. The benefit and advantage of the mounting arrangement of the present invention is evident from examples of the latest STINGER® model flashlights available from Streamlight, Inc. of Norristown, Pa., that were dropped from the roof of a two-story building onto a paved parking lot, i.e. from a height of about 30 feet, without breaking the lamp filament and were operated successfully thereafter.

The forward end of switch module 80 is adjacent to the rearward end of reflector 50 so as to position lamp 60 in desired relationship to reflector 50 and, specifically, to bore 52 therethrough. To that end, spring forces generated by flexible metal electrical contacts 85, 86 grasp pins 65 and 66, respectively, of lamp 60, thereby to mechanically support lamp 60 in the desired position within bore 52 of reflector 50 as well as make reliable electrical contact to pins 65, 66. Metal spring contacts 85, 86 connect via electrical conductors 94, 96, which are preferably metal strips molded plated onto surfaces of switch module 80, but which may be wires molded into or formed metal conductors selectively located in switch module 80, to connect to switch 82 and to a source of electrical power such as a battery B. In particular, the conductor 94 connects via switch 82 to the inner one of two concentric metal springs 97, 98 that bear respectively against the inner (positive) and outer (negative) contacts of battery B, and conductor 96 connects to the outer spring 98.

Because switch module 80 is accurately held in a prescribed position with respect to head housing 40 by flange 89 residing in groove 44, and because reflector 50 is also accurately held in a prescribed position with respect to head housing 40 by the engagement of threads 56 and threads 46, lamp 60 and filament 62 therein are held in a prescribed position with respect to reflector 50, and, in particular, with respect to parabolic light-reflecting surface 51 thereof. For flashlight 10 to produce a relatively narrow cylindrical beam of light, i.e. a tightly-collimated beam, filament 62 is positioned at the focus 53 of the parabolic surface 51 which lies along central axis 55. If lamp 60 is moved axially so that filament 62 is either forward of or rearward of focus 53, then the light beam will be less tightly collimated and will increase in diameter as it moves further from flashlight 10.

Figures 5A, 5B:
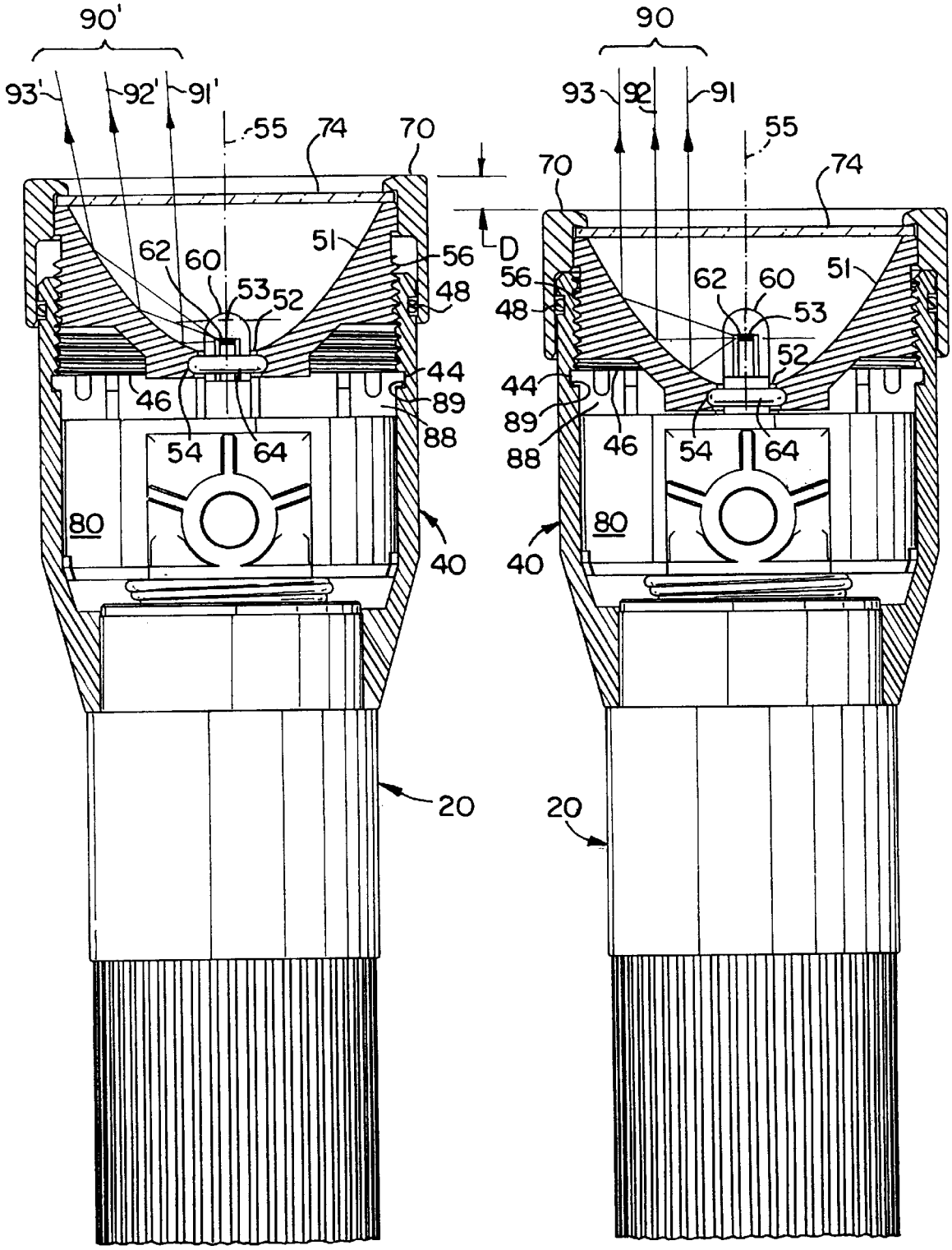
FIGS. 5A and 5B are sectional diagrams of the portion of the flashlight of FIG. 2 illustrating the focus-ability aspect of the flashlight of FIGS. 1 and 2.

The ability to move the filament axially with respect to the focus 53 of parabolic surface 51, and thereby de-focus the light beam, is actually a desirable feature of flashlight 10. To this end, as illustrated in FIGS. 5A and 5B, the press-fit assembly of reflector 50, lens ring 70 and lens 74 is rotatable with respect to head housing 40 and, as a result of the pitch of threads 56 of reflector 50 and of threads 46 of head housing 40, rotation of lens ring 70 causes reflector 50 to move axially with respect to head housing 40 and lamp filament 62 which is held in fixed position with respect to head housing 40 by spring contacts 85, 86 of switch module 80. In FIG. 5A, for example, lamp filament 62 is located substantially at the focus 53 of parabolic light-reflective surface 51 so that light rays 91, 92, 93 striking reflective surface 51 are reflected as a beam 90 of substantially parallel rays. In the reflection of light, the angle of incidence equals the angle of reflection. Of course, because filament 62 has a substantial physical dimension and is not a true "point source" of light, it cannot be "at" the focus 53, and so the light it produces does not all emanate from the focus 53. As a result, light beam 90 is collimated, but not perfectly, i.e. all the rays of light are not parallel to central axis 55.

In FIG. 5B, however, lens ring 70 is rotated so as to move reflector 50 forward axially by a distance D with respect to head housing 40 so that lamp filament 62 is located rearward of focus 53 by the same distance D. Because light rays 91', 92', 93' now impinge upon reflective surface 51 at an angle of incidence that is greater than the angle that would produce a collimated light beam, the angle of reflection is also greater and light rays 91', 92', 93', are reflected as a divergent beam of light 90', i.e. one that diverges from central axis 55 as it moves further away from flashlight 10.

Accordingly, it is seen that flashlight 10 desirably produces a beam of light that may be conveniently adjusted for varying degrees of divergence by simply rotating lens ring 70 with respect to housing 40. This is made possible because the shock absorbing arrangement for lamp 60, including O-ring 64 residing in circumferential groove 54 in bore 52 of reflector 50, need not tightly grip lamp 60, but may either lightly contact lamp 60 or not contact lamp 60 so long as it is sufficiently proximate thereto for lamp 60 to come into contact with O-ring 64 when flashlight 10 is dropped, banged or otherwise subjected to physical shock.

Flashlight 10 may be fabricated from various materials as are suitable for the particular degree of ruggedness and quality desired, and by the price that a purchaser might be willing to pay therefor. Barrel 20 and the parts thereof may be fabricated from various plastics and polymers, such as nylon, "super tough" nylon, ABS plastic or T-grade (telephone grade) ABS plastic, or from a metal such as aluminum, aircraft-grade aluminum, magnesium, steel or brass; machined aluminum is preferred. Like materials can be employed for head assembly 30 and the parts thereof; aluminum is preferred for head housing 40, reflector 50 and lens ring 70. Where reflector 50 is fabricated of metal, the metal may be polished to provide light-reflective surface 51 and that surface may or may not be plated, as by vacuum metallization or electroplating. Where reflector 50 is formed of a plastic, for example, reflective surface 51 is plated by vacuum metallization or electroplating. Lens 74 is preferably polycarbonate, although other transparent materials such as glass, tempered glass and the like may be employed. Switch module 80 is preferably molded of a thermoplastic such as polysulfone, however other materials such as nylon and PBT polyester may be employed. Spring contacts are preferably formed of brush-alloy-plated beryllium copper metal.

Because O-ring 64 will be immediately adjacent to and may be in contact with the outside of the glass bulb of lamp 60, and because a halogen lamp 60, for example, will operate at a high temperature, perhaps as high as 400–450 degrees Fahrenheit, O-ring 64 is formed of a resilient material that will not only cushion lamp 60, but will also be able to withstand such high temperature. Suitable O-rings are commercially available from Specification Seals Company of Anaheim, Calif. and from Parker Seals of Lexington, Ky. High temperature polysiloxane materials such as silicones are preferred for O-ring 54, and include Specification Seals types S500-70 and S567-70 silicones and Parker Seals type S1224-70 silicone. O-ring 48 may be formed of like material or of more common materials such as rubber or fluorinated hydrocarbons such as fluoro-elastomers.

Figure 6:
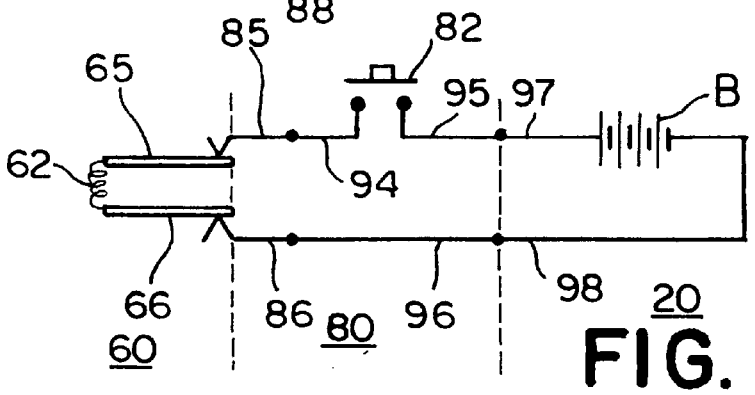
FIG. 6 is an exemplary electrical schematic diagram of the flashlight of FIGS. 1 through 5B.

In FIG. 6 is shown an exemplary electrical schematic diagram of flashlight 10. Battery B in barrel 20 is electrically connected to switch module 80 by electrical leads 97, 98 which are preferably formed of conductive wires or stamped metal parts routed and appropriately insulated within a battery B and concentric metal springs. Alternatively, such wires and metal parts may be formed and located within barrel 20, or metal conductors may be deposited on the interior surface of barrel 20, such as by plating. Lead 97 is electrically connected to one terminal of bush-button switch 82 by electrical lead 95 of switch module 80 and the other terminal of switch 82 is connected to spring contact 85 by electrical lead 94 of switch module 80. Battery lead 98 is electrically connected to spring contact 86 by electrical lead 96 of switch module 80. Electrical leads 94, 95, 96 of switch module 80 may be formed of metal wires or stamped metal parts molded therein, but are preferably metal conductors deposited on the surfaces of switch module 80, such as by plating. Spring contacts 85, 86 of switch module 80 make electrical contact with pin leads 65, 66, respectively, of lamp 60 between which filament 62 is connected. Push-button 82 alternates between "make" and "break" connection states upon successive actuations. Depressing push-button 82 a first time makes electrical contact between the two terminals of switch 82, thereby completing the electrical circuit and enabling current from battery B to flow through lamp filament 62 to thereby produce light. Depressing push-button 82 another time breaks electrical contact between the two terminals of switch 82, thereby opening the circuit and interrupting the flow of electrical current from battery B to lamp filament 62 to turn off the production of light.

While the present invention has been described in terms of the foregoing exemplary embodiments, variations within the scope and spirit of the present invention as defined by the claims following will be apparent to those skilled in the art. For example, while the exemplary embodiment described is a flashlight that is generally thought of as a small, hand-held device, the present invention can be employed with large lamps in trouble lights, spotlights and other devices that may or may not be intended to be used portably.

Moreover, while the exemplary lamp described above is a high-intensity xenon lamp, other types of light sources, such as a tungsten-filament or other low intensity lamp, or a halogen lamp or krypton lamp, or a light-emitting diode, supported by its electrical leads or otherwise non-rigidly held by its base, such as a wedge-type base, may beneficially be employed in the present invention. In addition, although the light herein has been described as a battery-powered flashlight, the present invention may be employed with lamps that are powered from other sources of electrical power, such as DC power from an automobile electrical system, AC or DC power from an aircraft electrical system, or AC power from the 110 volt AC or other power lines.

What is claimed is:

1. A lamp mounting arrangement comprising:

a lamp having electrical leads at one end thereof;

a reflector having a light-reflecting surface and a bore therethrough for receiving said lamp, wherein said bore has a circumferential grove therein;

an annular ring of resilient material in the groove of said bore; and an electrical connector engaging the electrical leads of said lamp for holding said lamp in the bore of said reflector within and proximate to said annular ring of resilient material and adapted for connecting said lamp to a source of electrical power.

2. The lamp mounting arrangement of claim 1 wherein said annular ring of resilient material is an O-ring.

3. The lamp mounting arrangement of claim 2 wherein said resilient material is a high-temperature silicone rubber.

4. The lamp mounting arrangement of claim 1 wherein said annular ring of resilient material has an inner diameter that is larger than an outer diameter of said lamp.

5. The lamp mounting arrangement of claim 1 wherein said annular ring of resilient material has an inner diameter that is not larger than an outer diameter of said lamp.

6. The lamp mounting arrangement of claim 1 wherein said annular ring of resilient material has an inner diameter that is substantially the same as an outer diameter of said lamp.

7. The lamp mounting arrangement of claim 1 wherein one of said reflector and said electrical connector is moveable with respect to the other of said reflector and said electrical connector for changing the relative positions of the filament of said lamp with respect to the light reflecting surface of said reflector.

8. The lamp mounting arrangement of claim 7 wherein said reflector is moveable with respect to a housing and said electrical connector is fixed with respect to said housing.

9. The lamp mounting arrangement of claim 1 wherein said lamp includes a tubular body and a bi-pin base.

10. The lamp mounting arrangement of claim 1 wherein said lamp includes a filament suspended between said electrical leads.

11. The lamp mounting arrangement of claim 1 wherein said electrical connector comprises an insulating body having metal spring contacts positioned for said engaging the electrical leads of said lamp for holding said lamp.

12. The lamp mounting arrangement of claim 11 wherein said insulating body includes electrical conductors located therein for electrically connecting said metal spring contacts to a source of electrical power.

13. The lamp mounting arrangement of claim 11 wherein said insulating body includes an electrical switch for selectively making and breaking electrical contact to at least one of said metal spring contacts.

14. The lamp mounting arrangement of claim 1 in combination with a battery, wherein said battery has respective terminals coupled via said electrical connector to the electrical leads of said lamp for being the source of electrical power.

15. A flashlight comprising:

a housing including a cavity adapted for receiving a battery;

a lamp having electrical leads at one end thereof; a reflector mounted to said housing and having a light-reflecting surface and a bore therethrough for receiving said lamp, said bore having a circumferential grove therein;

an annular ring of resilient material in the groove of said bore;

an electrical connector mounted to said housing and engaging the electrical leads of said lamp for holding said lamp in the bore of said reflector within and proximate to said annular ring of resilient material;

a terminal in the cavity of said housing adapted for connecting to a battery; and means for connecting said electrical connector and said lamp in circuit with said terminal.

16. The flashlight of claim 15 wherein said annular ring of resilient material is an O-ring.

17. The flashlight of claim 15 wherein said resilient material is a high-temperature silicone rubber.

18. The flashlight of claim 15 wherein said annular ring of resilient material has an inner diameter that is at least as larger as an outer diameter of said lamp.

19. The flashlight of claim 15 wherein said annular ring of resilient material has an inner diameter that is substantially the same as an outer diameter of said lamp.

20. The flashlight of claim 15 wherein said annular ring of resilient material has an inner diameter that is not larger than an outer diameter of said lamp.

21. The flashlight of claim 15 wherein one of said reflector and said electrical connector is moveable with respect to the other of said reflector and said electrical connector for changing the relative positions of the filament of said lamp with respect to the light reflecting surface of said reflector.

22. The flashlight of claim 21 wherein said reflector is moveable with respect to said housing and said electrical connector is fixed with respect to said housing.

23. The flashlight of claim 15 wherein said electrical connector comprises an insulating body having metal spring contacts positioned for said engaging the electrical leads of said lamp for holding said lamp.

24. The flashlight of claim 23 insulating body includes electrical conductors located therein for electrically connecting at least one of said metal spring contacts to said battery terminal.

25. The flashlight of claim 23 wherein said insulating body includes an electrical switch for selectively making and breaking electrical contact to at least one of said metal spring contacts.

26. The flashlight of claim 15 in combination with a battery, wherein said battery is in the cavity of said housing and is in electrical contact with said battery terminal for supplying electrical power to said lamp.

27. The flashlight of claim 15 wherein said lamp includes a tubular body and a bi-pin base.

28. The flashlight of claim 15 wherein said lamp includes a filament suspended between said electrical leads.

* * * * *